US006285012B1

(12) United States Patent
Connolly et al.

(10) Patent No.: US 6,285,012 B1
(45) Date of Patent: Sep. 4, 2001

(54) METHOD AND APPARATUS FOR THERMAL LIMITING OF THE TEMPERATURE OF A GLASS-CERAMIC COOKTOP

(75) Inventors: Allan John Connolly, Albany; Austars Raymond Schnore, Jr., Scotia, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/656,245

(22) Filed: Sep. 6, 2000

(51) Int. Cl.[7] ..... H05B 3/02; H05B 1/02; H05B 3/68

(52) U.S. Cl. ..... 219/481; 219/510; 219/448.11

(58) Field of Search ..... 219/481, 482, 219/490, 492, 494, 497, 509, 510, 448.11, 448.12, 460.1

(56) References Cited

U.S. PATENT DOCUMENTS 4,237,368 * 12/1980 Welch ..... 219/448.17
4,740,664 * 4/1988 Payne et al. ..... 219/448.17
5,352,866 * 10/1994 Cartwright et al. ..... 219/497
5,582,756 * 12/1996 Koyama ..... 219/497
5,603,772 * 2/1997 Ide ..... 118/724
5,793,022 * 8/1998 Klinck et al. ..... 219/483
6,018,150 * 1/2000 Maher, Jr. ..... 219/497

* cited by examiner

*Primary Examiner*—Sang Paik
(74) *Attorney, Agent, or Firm*—John F. Thompson; Jill M. Breedlove

(57) ABSTRACT

The temperature of a cooktop is controlled such that a maximum temperature of a cooktop reaches about a predetermined maximum temperature. The temperature is controlled by controlling power supplied to a radiant heating element positioned below the cooktop. The radiant heating element heats the cooktop. A user power input device allows a user to select a user power level corresponding to a desired temperature range for heating the cooktop. A temperature sensor is supplied that senses the temperature of the cooktop. A thermal limiter controller is connected to the radiant heating element, the user power input device and the temperature sensor. The thermal limiter controller determines a thermal limiting power level. The thermal limiter controller applies the smaller of the user power level and the thermal limiter power level to the radiant heating element. An anti-wind up controller is connected to the thermal limiter controller and tracks the thermal limiter power level to the user power level whereby a maximum temperature of the cooktop reaches about the predetermined maximum temperature.

25 Claims, 5 Drawing Sheets

METHOD AND APPARATUS FOR THERMAL LIMITING OF THE TEMPERATURE OF A GLASS-CERAMIC COOKTOP

BACKGROUND OF THE INVENTION

The present invention relates to controlling temperatures of a cooktop and more particularly to limiting the temperature of a glass-ceramic cooktop such that a maximum temperature of the cooktop reaches about a predetermined maximum temperature.

The new trend in electronically controlled cooktops and/or ranges, typically, includes a cooktop surface composed of a glass-ceramic material that is positioned above one or more radiant heating elements. The electronically controlled cooktop includes various user controls that are operated by a user to adjust the amount of heat and, ultimately, the temperature desired for cooking. The radiant heating elements can be powered by electricity, natural gas or other sources. Typically, the radiant heating element and the user controls are connected to a controller that controls the amount of heat supplied to the cooktop. The electronically controlled cooktop also includes temperature and other sensor that are connected to the controller to aid in controlling the heat supplied by the radiant heating source. The temperature and other sensors can also be used in conjunction with the controller to detect certain conditions that can arise during operation of the cooktop.

To increase the service life of the glass-ceramic cooktop, the temperature of the glass-ceramic cooktop should not exceed a predetermined maximum temperature for extended periods of time. Typically, the temperature of the glass-ceramic cooktop is affected by several factors during operation. The power level selected by the user using a user control interface is an important factor affecting the temperature of the glass-ceramic cooktop. Generally, the user power selection results in a temperature of the glass-ceramic cooktop that is below the predetermined maximum temperature. However, the user power selection along with other dynamics and/or factors involved with the operation of the glass-ceramic cooktop can cause the temperature of the glass-ceramic cooktop to rise above the predetermined maximum temperature. As mentioned above, exposure to a temperature above the predetermined maximum temperature for extended periods of time may reduce the service life of the glass-ceramic cooktop.

The other dynamics and/or factors that affect the glass-ceramic cooktop temperature include, such as, for example, the type of cooking utensil used, the thermal conductivity of the cooking utensil, the contents of the cooking utensil and user manipulation of all of these dynamics and/or factors. The type of cooking utensil affects the temperature of the glass-ceramic cooktop because the size and manufacturer of the cooking utensil can affect the thermal conductivity of the cooking utensil. The thermal conductivity of the cooking utensil relates to the ability of the cooking utensil to transfer heat from the radiant heating element to the contents of the cooking utensil. In addition, factors, such as, for example, the material composition of the cooking utensil, the thickness of the cooking utensil, the flatness and/or warping of the bottom of the cooking utensil also affect the thermal conductivity of the cooking utensil. These factors affect the contact interface area between the cooking utensil and the glass-ceramic cooktop, and the dynamics of this interface area are important factors in determining the thermal conductivity of the cooking utensil. In addition, the contents of the cooking utensil or lack thereof can affect the temperature of the glass-ceramic cooktop because, for example, a cooking utensil that has boiled dry can cause the glass-ceramic cooktop temperature to increase. Additionally, the user can alter or manipulate some or all of these factors/dynamics during the cooking process by, for example, adding more contents to the cooking utensil and/or moving or rocking the cooking utensil on the glass-ceramic cooktop surface during the cooking process.

As stated above, various factors and/or dynamics can cause the temperature of the glass-ceramic cooktop to exceed the predetermined maximum temperature, and therefore, potentially reduce the service life of the glass-ceramic cooktop. Therefore, there is a desire to control the power supplied to the radiant heating element such that a maximum temperature of the glass-ceramic cooktop reaches about the predetermined maximum temperature and/or does not exceed the predetermined maximum temperature within accepted tolerance limits.

BRIEF SUMMARY OF THE INVENTION

In one exemplary embodiment, an apparatus is provided that controls the temperature of a glass ceramic cooktop so that a maximum temperature of the glass ceramic cooktop reaches about a predetermined maximum temperature. The apparatus comprises a radiant heating element positioned below the glass ceramic cooktop that heats the glass ceramic cooktop. A user power input device allows a user to select a user power level corresponding to a desired temperature range for heating the glass ceramic cooktop. A temperature sensor senses the temperature of the glass ceramic cooktop. A thermal limiter controller is connected to the radiant heating element, the user power input device and the temperature sensor. The thermal limiter determines a thermal limiting power level. The thermal limiter controller comprises a proportional-integral (PI) controller circuit that receives at least the predetermined maximum temperature and the temperature of the glass ceramic cooktop. The PI controller circuit also produces a proportional-integral (PI) output power level. A minimum selector is connected to the PI circuit and the radiant heating element. The minimum selector receives the PI output power level and the user power level. The minimum selector also provides a minimum selector power output to the radiant heating element. In addition, the minimum selector power output comprise the smaller of the PI output power level and the user power level wherein the minimum selector power output. An anti-wind up controller is connected to the thermal limiter controller. The anti-wind up controller tracks the thermal limiter power level to the user power level. Also, the anti-wind up controller comprises a summation circuit that is connected to the thermal limiter controller. The summation circuit receives the PI output power level and the minimum selector power output. The summation circuit subtracts the PI output power level from the minimum selector power output and provides an output to the thermal limiter controller whereby the output of the anti-wind wind up controller is substantially zero when the PI output power level is being supplied to the radiant heating element.

In another exemplary embodiment, a method is provided that limits the power applied to a radiant heating device positioned below a glass ceramic cooktop. The temperature of the cooktop is limited such that a maximum temperature of the cooktop reaches about a predetermined maximum temperature. The method comprises measuring a temperature of the glass ceramic cooktop. The predetermined maximum temperature is subtracted from the temperature of the glass ceramic cooktop to produce a temperature difference output. The temperature difference output is added to a first feedback output level to produce a tracking output. The tracking output is integrated to product a first integrator output. The first integrator output is amplified to produce an amplified first integrator output. The amplified first integrator output is subtracted from the temperature of the glass ceramic cooktop to product an integrator difference output. The integrator difference output is amplified to form a proportional-integral (PI) power level. A user input power level is provided that corresponds to a desired temperature range for heating the glass ceramic cooktop. The minimum selector power output is supplied to the radiant heating device. The minimum selector power output is the smaller of the user input power level and the PI power level, the minimum selector power output is supplied to the radiant heating element.

DETAILED DESCRIPTION OF THE INVENTION

Figure 1:
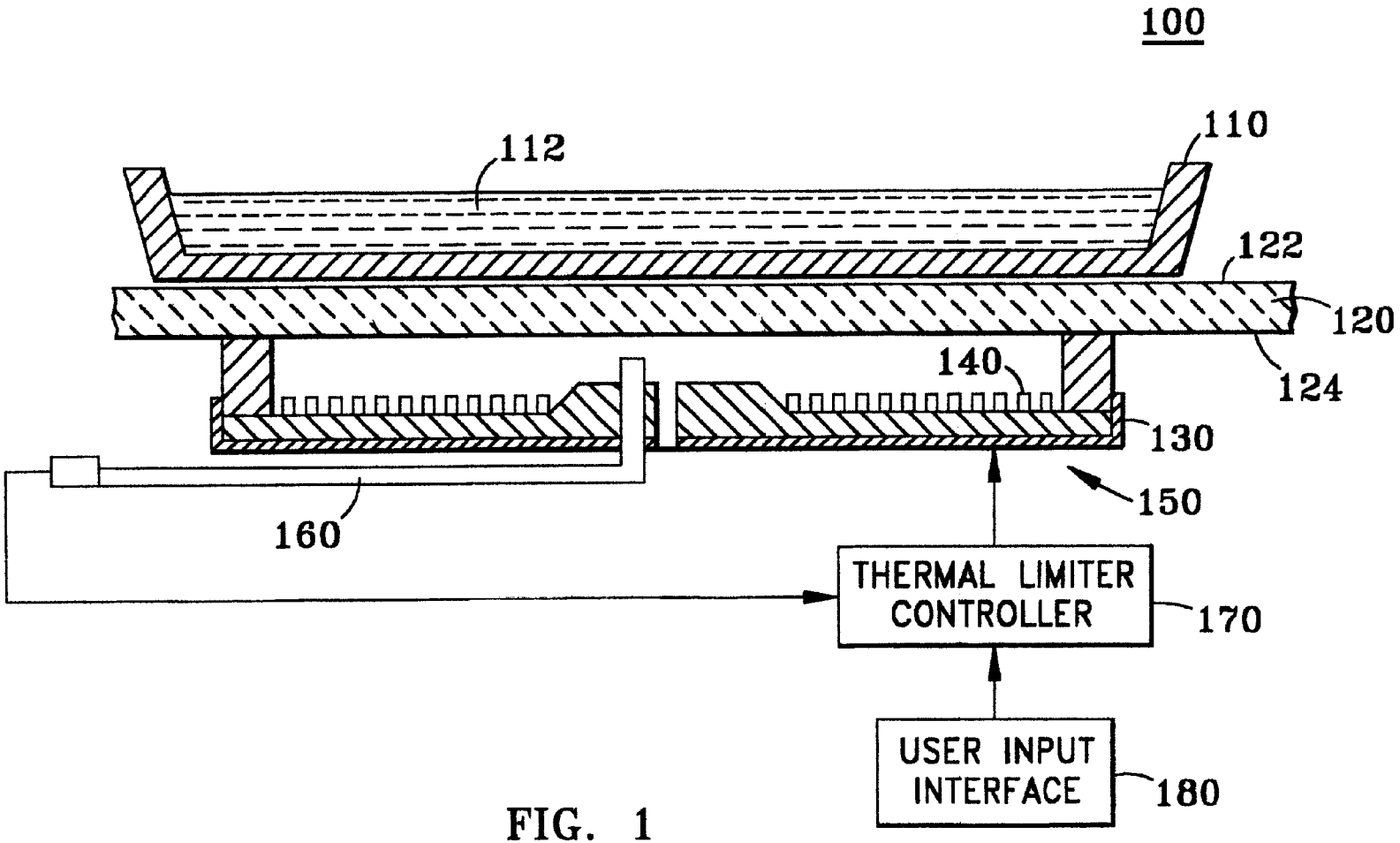
FIG. 1 is a sectional view and a block diagram of one exemplary embodiment of an electronically controlled cooktop.
Figure 2:
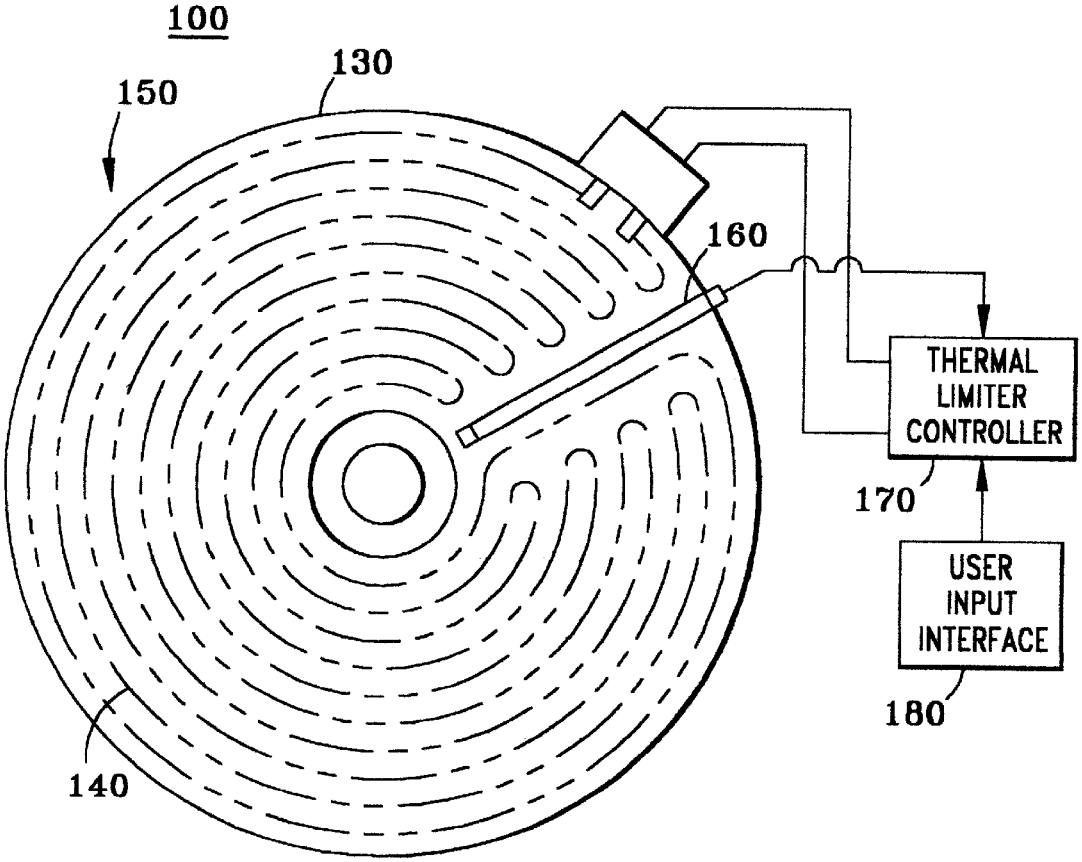
FIG. 2 is a top view of and a block diagram view of another exemplary embodiment of an electronically controlled cooktop.

As shown in FIGS. 1 and 2, one exemplary embodiment of an electronically controlled cooktop 100 includes a cooktop 120 having a top surface 122 and a bottom surface 124. The cooktop 120 is positioned above a radiant heating element 140 that is housed in a heating unit 150 having an element housing 130. A cooking utensil 110 is positioned on the top surface 122 of the cooktop 120. The cooking utensil 110 contains contents 112. A temperature sensor 160 senses the temperature of the cooktop 120. In one embodiment, the temperature sensor 160 is positioned proximate to the bottom surface 124 of the cooktop 120. In another embodiment, the temperature sensor 160 is positioned inside the cooktop 120 between the top surface 122 and the bottom surface 124. It should be appreciated that in one embodiment, the temperature sensor 160 comprises an acoustic sensor that measures the temperature of the cooktop 120. It should also be appreciated that, in other embodiments, the temperature sensor 160 can comprise, for example, a contact sensor, a rod sensor, a thermocouple, a thermistor or any other sensor that can directly or indirectly measure the temperature of the cooktop 120. In one embodiment, a measured temperature ($T_{meas}$) of the cooktop 120 is determined by the placement of the temperature sensor 160. The measured temperature ($T_{meas}$) can actually be a predetermined distance from the cooktop 120 and the measured temperature ($T_{meas}$) may be less than the actual temperature of the cooktop 120. In addition in other embodiments, the temperature sensor 160 can measure the actual temperature of the cooktop 120, therefore, the measured temperature ($T_{meas}$) will be equal to the actual temperature of the cooktop 120. Thus, based on the temperature sensor 160 and/or the placement of the temperature sensor 160, the predetermined maximum temperature ($T_{max}$) can change from embodiment to embodiment based on the temperature being measured by the temperature sensor 160.

A thermal limiter controller 170 is connected to the temperature sensor 160 and receives the measured temperature ($T_{meas}$) of the cooktop 120. A user input interface 180 is connected to the thermal limiter controller 170. The user input interface 180 contains various pre-selected power settings (not shown) so that a user can select a desired power level (user input power level ($P_{UI}$)) such that the contents 112 of the cooking utensil 110 heats to a temperature desired by the user during the cooking process. The thermal limiter controller 170 is also connected to the radiant heating element 140 of the heating unit 150. The thermal limiter controller 170 receives the measured temperature ($T_{meas}$) and user input power level ($P_{UI}$) and provides a thermal limiter power output ($P_{CMD}$) to the radiant heating element 140 such that a maximum of the measured temperature ($T_{meas}$) of the cooktop 120 reaches about a predetermined maximum temperature ($T_{max}$). In addition, the thermal limiter controller 170 takes into account for the various factors and/or dynamics such that the maximum of the measured temperature ($T_{meas}$) of the cooktop 120 reaches about a predetermined maximum temperature ($T_{max}$). In one embodiment, the predetermined maximum ($T_{max}$) is programmed and/or stored in a memory device (not shown) and is supplied to the thermal limiter controller 170. It should be appreciated that the electronically controlled cooktop 100 can include a plurality of radiant heating elements 140 and a separate thermal limiter controller 170 for each of the plurality of radiant heating elements 140. In addition, the user input interface 180 can also be connected to each of the plurality of radiant heating elements 140. It should also be appreciated that in other embodiments the electronically controlled cooktop 100 can include other power controllers (not shown) and/or signal processing devices (not shown) connected to, at least, the radiant heating element 140, the temperature sensor 160 and other various sensors (not shown). These other power controllers (not shown) and/or signal processing devices (not shown) perform signal processing and other controlling of the power levels supplied to the radiant heating element 140 based on other factors and/or dynamics in the electronically controlled cooktop 100 during the cooking/heating process. In addition, the thermal controller 170 controls the power supplied to the radiant heating element 140 such that the maximum of the temperature ($T_{meas}$) of the cooktop 120 reaches about the predetermined maximum temperature ($T_{max}$). In limiting the maximum of the measured temperature ($T_{meas}$) of the cooktop 120, the measured temperature ($T_{meas}$) may exceed the predetermined maximum temperature ($T_{max}$) within accepted tolerances, such as, for example, about ±2 to 3° C.

Figure 3:
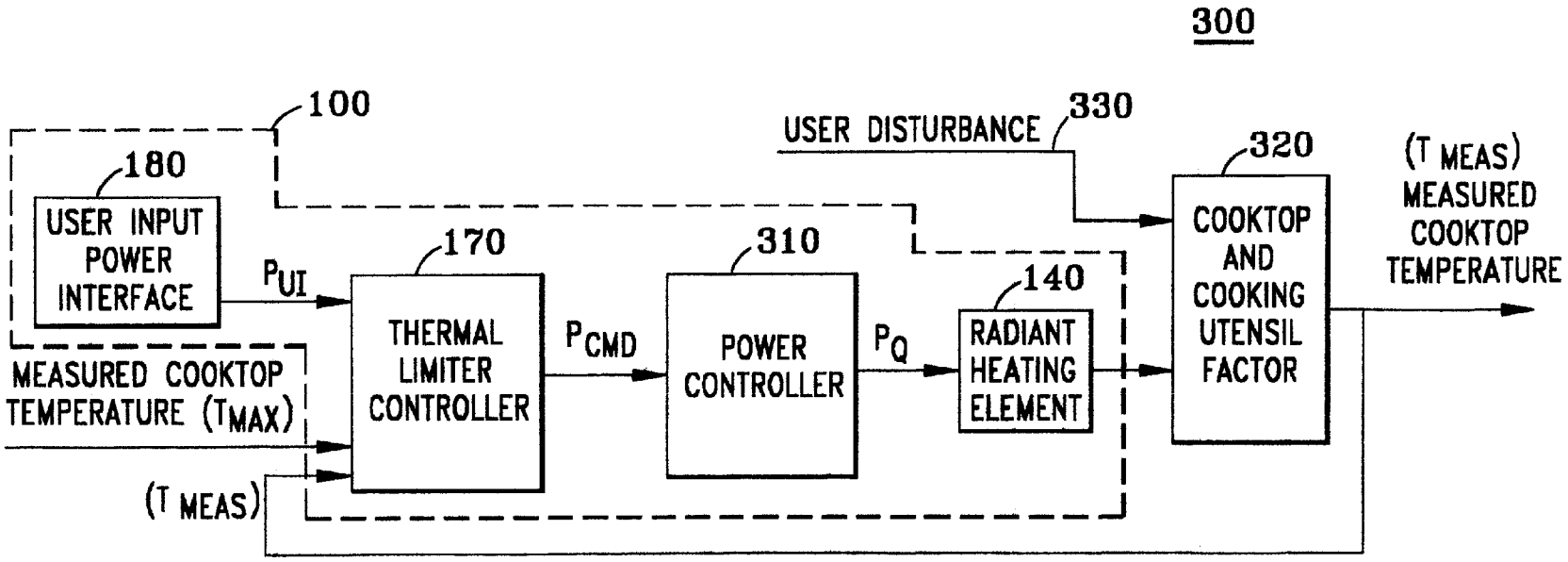
FIG. 3 is a block diagram of one exemplary embodiment of a cooktop heating dynamic diagram.

In one embodiment as shown in FIG. 3, the electronically controlled cooktop 100 can also comprises a power controller 310 that is connected between the thermal limiter controller 170 and the radiant heating element 140. The power controller 310 adjusts the thermal limiter power output ($P_{CMD}$) to a discreetly quantized or continuous power level ($P_Q$) and supplies the power level ($P_Q$) to the radiant heating element 140. In one embodiment, the power controller 310 comprises a quantizer that uses cycle skipping to supply power to the radiant heating element 140. The cycle skipping allows the quantizer to provide a plurality of quantization levels, such as, for example, a number of quantization levels greater than two. In another embodiment, the power controller 310 can comprise a continuous power output rather than discreetly quantized power output levels. In even another embodiment, the power controller 310 comprises a linear controller or any other power output device to provide power to the radiant heating element 140. In addition, it should also be appreciated, in other embodiments as shown in FIGS. 1 and 2, that the power controller 310 is not included in the electronically controlled cooktop 100 and the thermal limiter controller 170 provides an power output to the radiant heating element 140. Additionally, the power controller 310 may be implemented via hardware, software or algorithm implemented in hardware or software, and the power controller 310 may be included externally from the thermal limiter controller 170.

As shown in FIG. 3, the electronically controlled cooktop 100 is part of a cooktop heating dynamic diagram 300 that includes various factors and/or dynamics affecting the measured temperature ($T_{meas}$) of the cooktop 120 and to the cooking utensil 110. In one embodiment, the cooktop heating dynamic diagram 300 indicates that the electronically controlled cooktop 100 and a user disturbance 330 both combine in a cooktop and cooking utensil factor 320 to affect the measured temperature ($T_{meas}$) of the cooktop 120. The electronically controlled cooktop 100 affects the measured temperature ($T_{meas}$) of the cooktop 120 by providing a controlled heat output level via the radiant heating element 140. The user disturbance 330 takes into account for various factors under the user's control that can affect the measured temperature ($T_{meas}$) of the cooktop 120 and/or cooking utensil 110. These factors include, such as, for example, the amount of contents 112 added to the cooking utensil 110, the thermal conductivity of the cooking utensil 110 and the movement of the cooking utensil 110 on the top surface 122 of the cooktop 120. It should be appreciated that the cooktop and cooking utensil factor 320 may not necessarily be hardware type devices. Rather, the cooktop and cooking utensil factor 320 comprises various factors affecting the cooktop 120 and the cooking utensil 110, and these factors may be added or subtracted to ultimately affect the measured temperature ($T_{meas}$) of the cooktop 120 in an cooking environment sense. It should also be appreciated that other factors and/or dynamics (other than those described herein) may also affect the cooktop 120, the cooking utensil 110 and ultimately the measured temperature ($T_{meas}$) of the cooktop 120.

Figure 4:
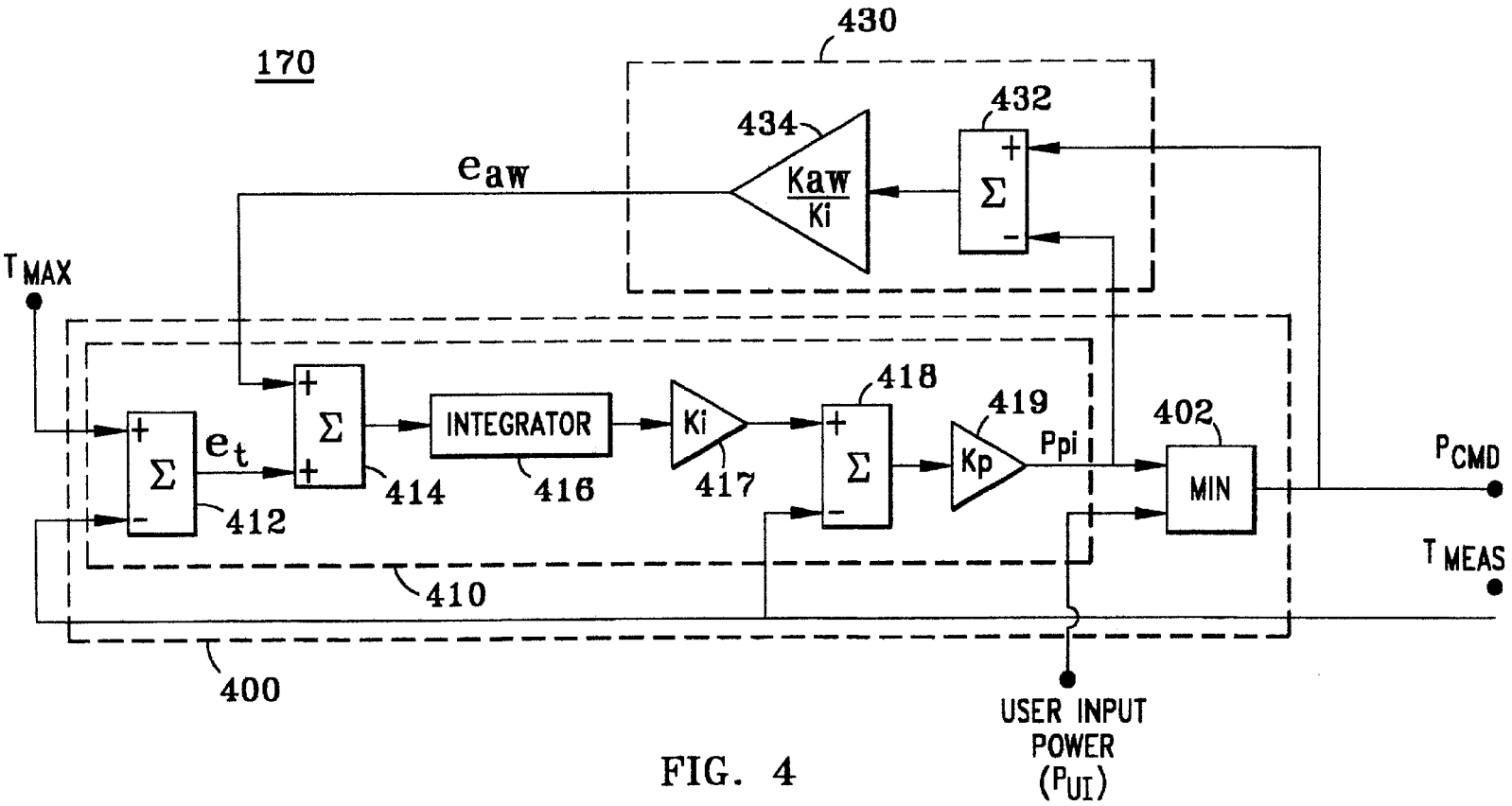
FIG. 4 is a block diagram of one exemplary embodiment of a thermal limiting controller.

In one embodiment shown in FIG. 4, the thermal limiter controller 170 comprises a thermal limiter 400 connected to an anti-wind up controller 430. The thermal limiter 400 comprises an proportional plus integral (PI) controller 410 connected to a minimum selector 402. The PI controller 410 comprises a first summer 412 receiving the predetermined maximum temperature ($T_{max}$) and the measured temperature ($T_{meas}$) of the cooktop 120. The first summer 412 subtracts the measured temperature ($T_{meas}$) from the predetermined maximum temperature ($T_{max}$) and the output ($e_t$) is provided to a second summer 414. An anti-wind up error output ($e_{aw}$) is also supplied to the second summer 414, and the second summer 414 adds the output ($e_t$) from the first summer 412 to the anti-wind up error output ($e_{aw}$). The anti-wind up error output ($e_{aw}$) is a feedback output level resulting from the comparison of the thermal limiter power level ($P_{CMD}$) and the proportional plus integral (PI) power output ($P_{pi}$). The output from the second summer 414 is supplied to an integrator 416 that integrates the second summer 414 output signal. The output from the integrator 416 is supplied to an integrator amplifier 417 having a gain of $K_i$ (integral gain) that comprises a predetermined gain level. The output from the integrator amplifier 417 is connected to a third summer 418 that subtracts the measured temperature ($T_{meas}$) from the output of the integrator amplifier 417. The output of the third summer 418 is supplied to an output amplifier 419 having a gain of $K_p$ (proportional gain) that comprises a predetermined gain level. The output from the output amplifier 419 is the PI power output ($P_{pi}$) from the PI controller 410. The minimum selector 402 receives the PI power output ($P_{pi}$) and the user input power ($P_{UI}$) from the user input interface 180. In addition, the minimum selector 402 supplies the smaller of the PI power output ($P_{pi}$) and the user input power ($P_{UI}$) as the thermal limiter power output ($P_{CMD}$) that is supplied as the output of the thermal limiter controller 170.

The anti-wind up controller 430 comprises an anti-wind up summer 432 connected to an anti-wind up amplifier 434. The anti-wind up summer 432 receives the PI power output ($P_{pi}$) and the thermal limiter power output ($P_{CMD}$) and subtracts the PI power output ($P_{pi}$) from the thermal limiter power output ($P_{CMD}$). The output of the anti-wind up summer 432 is supplied to the anti-wind up amplifier 434 having gain ($K_{aw}/K_i$) that is a predetermined anti-wind up gain ($K_{aw}$) divided by the predetermined integrator gain ($K_i$) (integral gain). The gain ($K_{aw}/K_i$) of the anti-wind up amplifier 434 is a predetermined gain level. The output of the anti-wind up amplifier 434 comprises the anti-wind up error output ($e_{aw}$) that is supplied to the second summer 414 of the PI controller 410. It should be appreciated that, in other embodiments, the anti-wind up controller 430 can be located outside the thermal limiter controller 170. It should also be appreciated that, in one embodiment, the temperatures and power levels described herein and shown in FIGS. 1–5 are voltage signals representative of the temperatures and/or power output levels. Therefore, the summation, amplification, integration and other operations, as shown in FIG. 4, are manipulations of these voltage signals that represent the temperature and power output levels. Also, it should be appreciated that the manipulation of the voltage signals can be performed via hardware or via software and/or an algorithm implemented in hardware or software.

Figure 5:
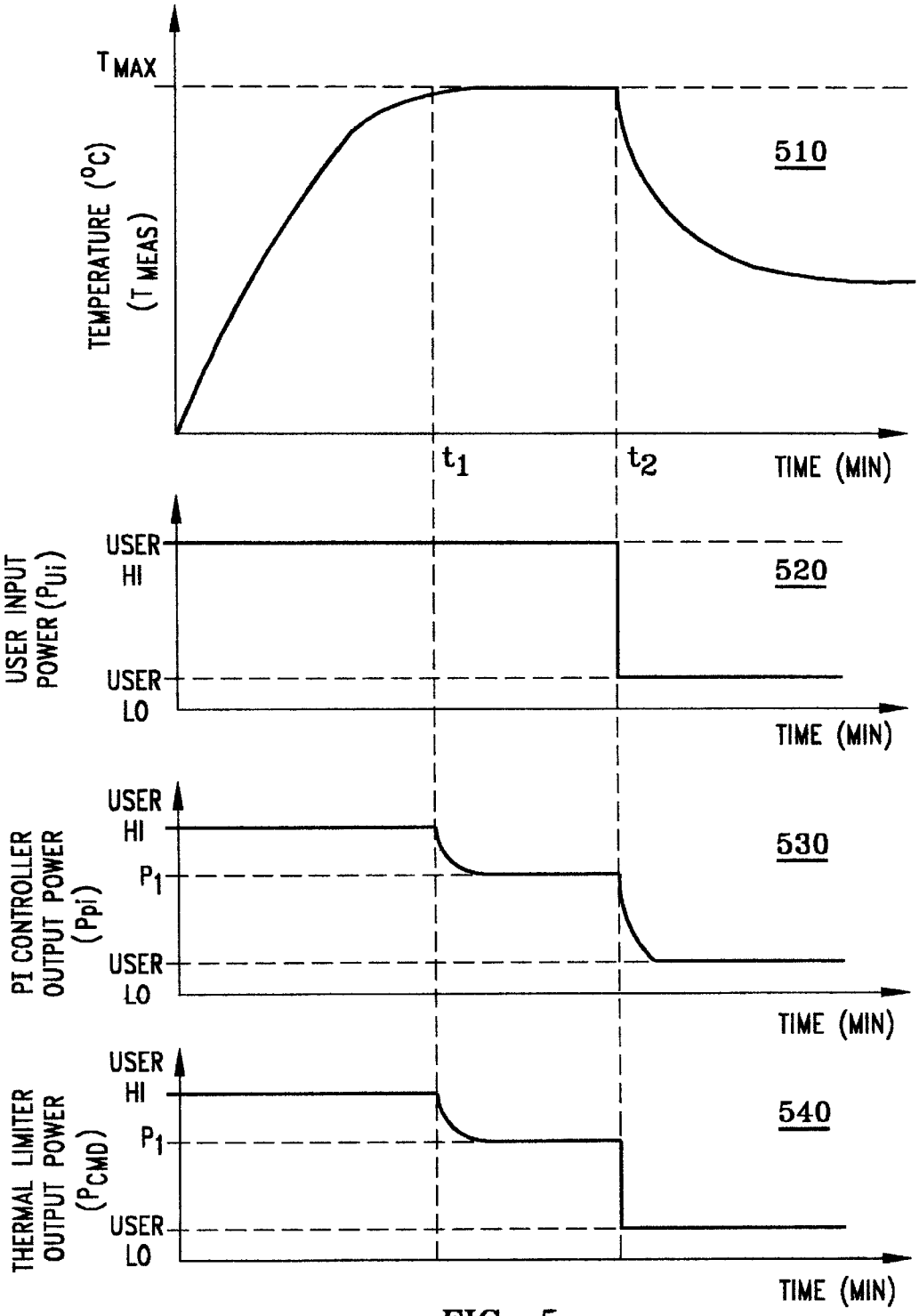
FIG. 5 is graphs illustrating measured cooktop temperature over time and various power outputs over time.

As described herein above, the thermal limiter controller 170 receives the inputs of the predetermined maximum temperature ($T_{max}$), the user input power level ($P_{UI}$) and the measured temperature ($T_{meas}$) of the cooktop 120. Using these inputs, the thermal limiter controller 170 operates to control the thermal limiter power output ($P_{CMD}$) such that a maximum of the measured temperature ($T_{meas}$) of the cooktop 120 reaches about the predetermined maximum temperature ($T_{max}$). In FIG. 5, the measured temperature ($T_{meas}$) of the cooktop 120 versus time, in plot 510, show a typical temperature profile of the electronically controlled cooktop 100 as a user adjusts the input power via the user input interface 180. Additionally, in FIG. 5, the user input power level ($P_{UI}$) versus time plot 520 shows an exemplary user power inputs that switch between a high power level (user hi) and a low power level (user lo). Corresponding to the high power (user hi), the measured temperature ($T_{meas}$) increases until about time $t_1$. At this time, the measured temperature ($T_{meas}$) is thermally limited via the thermal limiter controller 170 to about the predetermined maximum temperature ($T_{max}$). As the measured temperature ($T_{meas}$) of the cooktop 120 reaches about the predetermined maximum temperature ($T_{max}$), the thermal limiter controller 170 takes over control of the power ($P_{CMD}$) supplied to the radiant heating element 140. The anti-wind up controller 430 also limits the measured temperature ($T_{meas}$) of the cooktop 120 to allow a smooth transition to about the predetermined maximum temperature ($T_{max}$). It should be appreciated that the gains $K_i$, $K_p$ and $K_{aw}$ are chosen to provide the desired performance such that the temperature ($T_{meas}$) of the cooktop 120, in one embodiment, does not exceed (beyond accepted tolerances, such as, for example, about ±2 to 3° C.) the predetermined maximum temperature ($T_{max}$).

As shown in the plot 530 of the PI power output ($P_{pi}$) versus time and the plot 540 of the thermal limiter power output ($P_{CMD}$) versus time, the thermal limiter power output ($P_{CMD}$) is equivalent to the user input power level ($P_{UI}$) until time $t_1$. At the time $t_1$, the PI power output ($P_{pi}$) becomes lower than the user input power ($P_{UI}$) and the minimum selector 402 makes the thermal limiter output ($P_{CMD}$) equal to the PI power output ($P_{pi}$). This power level change lowers the thermal limiter power output ($P_{CMD}$) to power level $P_1$ and ensures that the maximum of the measured temperature ($T_{meas}$) of the cooktop 120 reaches about the predetermined maximum temperature ($T_{max}$). As shown in plot 510, the lowering of the thermal limiter output power ($P_{CMD}$) to power level $P_1$ causes the measured temperature ($T_{meas}$) of the cooktop 120 to stabilize at about the predetermined maximum temperature ($T_{max}$).

The transition of the thermal limiter output power ($P_{CMD}$) from the user input power level ($P_{UI}$) to the PI power output ($P_{pi}$) is seamless and devoid of any thermal spikes and unreasonable variation/drift/overshoot in the measured temperature ($T_{meas}$) of the cooktop 120 does not occur. This temperature transition operation is seamless because the anti-wind up controller 430 allows the PI controller 410 to track the measured temperature ($T_{meas}$) rather than winding up to a maximum integral value. If the PI controller 410 was allowed to wind up to the maximum integral value, the measured temperature ($T_{meas}$) could overshoot or exceed the predetermined maximum temperature ($T_{max}$) beyond accepted tolerances before the power level was tracked to the thermally limited PI output power ($P_{pi}$).

At time $t_2$, the user input power level ($P_{UI}$) is reduced to low power (user lo). As such, the measured temperature ($T_{meas}$) decreases below the predetermined maximum temperature ($T_{max}$). In addition, at time $t_2$, the thermal limiter controller 170 is no longer required to maintain the measured temperature ($T_{meas}$) at or near the predetermined maximum temperature ($T_{max}$) because the measured temperature ($T_{meas}$) of the cooktop 120 has decreased. Therefore, the thermal limiter power output ($P_{CMD}$) is equivalent to the user input power level ($P_{UI}$) as shown in plot 540. It should be appreciated that the change at time $t_2$ of the user input power level ($P_{UI}$) from the high power (user hi) to the low power (user lo) is an exemplary act by the user that is one factor represented in the user disturbance 330 (FIG. 3) dynamic.

As such, the thermal limiter controller 170 can take control of the thermal limiter output power ($P_{CMD}$) supplied to the radiant heater 140 to ensure that the measured temperature ($T_{meas}$) reaches about the maximum temperature ($T_{max}$). The anti-wind up controller 430 allows the PI controller 410 to track the measured temperature ($T_{meas}$) such that about the predetermined maximum temperature ($T_{max}$) is reaches and not exceeded beyond accepted tolerances, such as, for example, about ±2 to 3° C. When a user input power level ($P_{UI}$) is selected that does not cause the measured temperature ($T_{meas}$) to exceed the maximum temperature ($T_{max}$), the thermal limiter controller 170 no longer controls the thermal limiter output power ($P_{CMD}$) applied to the radiant heating element 140. Therefore, at these times the user input power level ($P_{UI}$) is applied to the radiant heating element 140.

The foregoing discussion of the invention has been presented for purposes of illustration and description. Further, the description is not intended to limit the invention to the form disclosed herein. Consequently, variations and modifications commensurate with the above teachings, with the skill and knowledge of the relevant art, are within the scope of the present invention. The embodiment described herein above is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. An apparatus for controlling a temperature of a cooktop such that a maximum temperature of the cooktop reaches about a predetermined maximum temperature, the apparatus comprising:

a radiant heating element positioned below the cooktop for heating the cooktop;

a thermal limiter controller connected to the radiant heating element for determining a thermal limiting power level;

a user power input device connected to the thermal limiter controller for allowing a user to select a user power level corresponding to a desired temperature range for heating the cooktop;

a temperature sensor connected to the thermal limiter controller for sensing the temperature of the cooktop; and an anti-wind up controller connected to the thermal limiter controller for tracking the thermal limiter power level to the user power level whereby the thermal limiter controller applies the smaller of the user power level and the thermal limiter power level to the radiant heating element such that the maximum temperature of the cooktop reaches about the predetermined maximum temperature.

2. The apparatus of claim 1 wherein the thermal limiter controller comprises:

a minimum selector connected to the radiant heating element; and an proportional plus integral (PI) controller circuit connected to the minimum selector and receiving the predetermined maximum temperature, the temperature of the cooktop and an output from the anti-wind up controller for producing an proportional plus integral (PI) output power level such that the maximum temperature of the cooktop reaches about the predetermined maximum temperature, wherein the minimum selector receives the PI output power level and the user power level and provides a minimum selector power output to the radiant heating element, the minimum selector power output comprising the smaller of the PI output power level and the user power level.

3. The apparatus of claim 2 wherein the anti-wind up controller comprises:

a summation circuit connected to the thermal limiter controller and receiving the PI output power level and the minimum selector power output, the summation circuit subtracting the PI output power level from minimum selector power output and providing an output to the thermal limiter controller whereby the output of the anti-wind up controller is substantially zero when the PI output power level is being supplied to the radiant heating element.

4. The apparatus of claim 1 further comprising a power controller connected to the thermal limiter controller and the radiant heating element, the power controller controlling a power level output from the thermal limiter controller and applying the controlled power output to the radiant heating element.

5. The apparatus of claim 1 wherein the temperature sensor is positioned proximate to the cooktop.

6. The apparatus of claim 1 wherein the cooktop comprises a glass ceramic cooktop.

7. The apparatus of claim 6 wherein the temperature sensor is located inside the glass ceramic cooktop.

8. The apparatus of claim 1 wherein the thermal limiter controller comprises the anti-wind up controller.

9. An apparatus for controlling a temperature of a glass ceramic cooktop such that a maximum temperature of the glass ceramic cooktop reaches about a predetermined maximum temperature, the apparatus comprising:

a radiant heating element positioned below the glass ceramic cooktop for heating the glass ceramic cooktop;

a thermal limiter controller connected to the radiant heating element for determining a thermal limiting power level, the thermal limiter controller comprising:

a minimum selector connected to the radiant heating element and producing a minimum selector power output; and an proportional plus integral (PI) controller circuit connected to the minimum selector and receiving at least the predetermined maximum temperature and the temperature of the glass ceramic cooktop and producing a proportional plus integral (PI) output power level;

a user power input device connected to the thermal limiter controller for allowing a user to select a user power level corresponding to a desired temperature range for heating the glass ceramic cooktop;

a temperature sensor connected to the thermal limiter controller for sensing the temperature of the glass ceramic cooktop; and an anti-wind up controller connected to the thermal limiter controller for tracking the thermal limiter power level to the user power level, the anti-wind up controller comprising:

a summation circuit connected to the thermal limiter controller and receiving the PI output power level and the minimum selector power output, the summation circuit subtracting the PI output power level from the minimum selector power output and providing an output to the thermal limiter controller, wherein the minimum selector receives the PI output power level and the user power level and provides the minimum selector power output to the radiant heating element, the minimum selector power output comprising the smaller of the PI output power level and the user power level whereby the output of the anti-wind up controller is substantially zero when the PI output power level is being supplied to the radiant heating element.

10. The apparatus of claim 9 further comprising a power controller connected to the thermal limiter controller and the radiant heating element, the power controller controlling a power level output from the thermal limiter controller and applying the controlled power output to the radiant heating element.

11. The apparatus of claim 9 wherein the temperature sensor is positioned proximate to the glass ceramic cooktop.

12. The apparatus of claim 9 wherein the temperature sensor is located inside the glass ceramic cooktop.

13. The apparatus of claim 9 wherein the thermal limiter controller comprises the anti-wind up controller.

14. An apparatus for limiting a temperature of a cooktop measured by a temperature sensor and the temperature is selected by at least a user power input device, the cooktop positioned above a radiant heating element, the apparatus comprising:

a thermal limiter controller connected to the radiant heating element, the user power input device and the temperature sensor, the thermal limiter controller determining a thermal limiting power level such that a maximum temperature of the cooktop reaches about a predetermined maximum temperature, the thermal limiter controller comprising:

a minimum selector connected to the radiant heating element; and an proportional plus integral (PI) controller circuit connected to the minimum selector for receiving at least the predetermined maximum temperature and the temperature of the cooktop and producing a proportional plus integral (PI) output power level;

wherein the minimum selector receives the PI output power level and the user power level and provides a minimum selector power output to the radiant heating element, the minimum selector power output comprising the smaller of the PI output power level and the user power level;

an anti-wind up controller connected to the thermal limiter controller for tracking the thermal limiter power level to the user power level, the anti-wind up controller comprising:

a summation circuit connected to the thermal limiter controller and receiving the PI output power level and the minimum selector power output, the summation circuit subtracting the PI output power level from the minimum selector power output and providing an output to the thermal limiter controller whereby the output of the anti-wind up controller is substantially zero when the PI output power level is being supplied to the radiant heating element.

15. The apparatus of claim 14 further comprising a power controller connected to the thermal limiter controller and the radiant heating element, the power controller controlling a power level output from the thermal limiter controller and applying the controlled power output to the radiant heating element.

16. The apparatus of claim 14 wherein the temperature sensor is positioned proximate to the cooktop.

17. The apparatus of claim 14 wherein the cooktop comprises a glass ceramic cooktop.

18. The apparatus of claim 17 wherein the temperature sensor is located inside the glass ceramic cooktop.

19. The apparatus of claim 14 wherein the thermal limiter controller comprises the anti-wind up controller.

20. A method for limiting the power applied to a radiant heating device positioned below a cooktop such that a maximum temperature of the cooktop reaches about a predetermined maximum temperature, the method comprising the steps of:

measuring a temperature of the cooktop;

determining an proportional plus integral (PI) power level from at least the temperature of the cooktop, the predetermined maximum temperature and a first feedback power level;

providing a user input power level corresponding to a desired temperature range for heating the cooktop; and applying a minimum selector power output to the radiant heating device, the minimum selector power output being the smaller of the user input power level and the PI power level.

21. The method of claim 20 wherein the first feedback output level comprises the difference between the minimum selector power output and the PI power level.

22. The method of claim 20 wherein the step of determining the PI power level comprises:

subtracting the predetermined maximum temperature from the temperature of the cooktop to produce a temperature difference output;

adding the temperature difference output to the first feedback output level to produce a tracking output;

integrating the tracking output to product a first integrator output;

amplifying the first integrator output to produce an amplified first integrator output;

subtracting the amplified first integrator output from the temperature of the cooktop to product an integrator difference output; and amplifying the integrator difference output to form the PI power level.

23. The method of claim 20 wherein the cooktop comprises a glass ceramic cooktop.

24. A method for limiting the power applied to a radiant heating device positioned below a glass ceramic cooktop such that a maximum temperature of the glass ceramic cooktop reaches about a predetermined maximum temperature, the method comprising the steps of:

measuring a temperature of the glass ceramic cooktop;

subtracting the predetermined maximum temperature from the temperature of the glass ceramic cooktop to produce a temperature difference output;

adding the temperature difference output to a first feedback output level to produce a tracking output;

integrating the tracking output to product a first integrator output;

amplifying the first integrator output to produce an amplified first integrator output;

subtracting the amplified first integrator output from the temperature of the glass ceramic cooktop to product an integrator difference output; and amplifying the integrator difference output to form an proportional plus integral (PI) power level;

providing a user input power level corresponding to a desired temperature range for heating the glass ceramic cooktop; and applying the minimum selector power output to the radiant heating device, the minimum selector power output being the smaller of the user input power level and the PI power level.

25. The method of claim 24 wherein the first feedback output level comprises the difference between the minimum selector power output and the PI power level.

* * * * *